United States Patent [19]

Ingram

[11] 4,301,549

[45] Nov. 24, 1981

[54] TENNIS BALL POCKET

[76] Inventor: Arlen E. Ingram, 32606 Barkley, Livonia, Mich. 48154

[21] Appl. No.: 167,797

[22] Filed: Jul. 14, 1980

[51] Int. Cl.[3] ..... A41D 27/20

[52] U.S. Cl. ..... 2/250

[58] Field of Search ..... 2/250, 247, 254

[56] References Cited

U.S. PATENT DOCUMENTS 2,558,382 6/1951 Previdi ..... 2/250

3,871,030 3/1975 Green ..... 2/250

3,968,522 7/1976 Riess ..... 2/250

*Primary Examiner*—Doris L. Troutman

*Attorney, Agent, or Firm*—Barnes, Kisselle, Raisch & Choate

[57] ABSTRACT

A tennis ball pocket for fastening to the garment of a player which holds an extra ball in readiness and designed to release the ball through a hole in the outer wall of the pocket upon finger pressure either outside the pocket or against the ball inside the pocket to cause the ball to pop into the hand of the player.

6 Claims, 6 Drawing Figures

TENNIS BALL POCKET

FIELD OF INVENTION

Devices for holding a tennis ball on the garment of a player where it is readily available for second serve.

BACKGROUND OF INVENTION

In tennis playing, the two-serve rule gives a player a second chance at a serve if the first serve is a fault because the ball hits the net or lands out of the serve area of the court. To save time, a player may retain a second ball in his or her hand for immediate use. On the other hand, if the first serve is good, the reserved ball must be discarded quickly so both hands will be free to return the serve. This is especially true if the player uses a two-hand backhand stroke. The discarded ball may not clear the play area and may cause an ankle injury if stepped on.

Thus, it is important that a means be provided to retain the reserve ball in a manner which makes it easily accessible, if needed, but which will be conveniently and easily carried if not used.

The present invention contemplates a special pocket, to be carried by or integral with a tennis garment such as a skirt or shorts, which will conveniently retain a tennis ball but enable the player to remove the ball with a simple push of the fingers inwardly and around the ball on the outside of the pocket to cause the ball to snap into the palm of the hand.

Other objects will be apparent in the following description and claims in which the principles of the invention are set forth together with the details which will enable persons skilled in the art to practice the invention, all in connection with the best mode presently contemplated for the invention.

DESCRIPTION OF THE DRAWINGS

Drawings accompany the disclosure and the various views thereof may be briefly described as:

FIG. 5, a view of a modification using belt loops for attachment of the pocket.

DETAILED DESCRIPTION OF THE INVENTION

Figure 1:
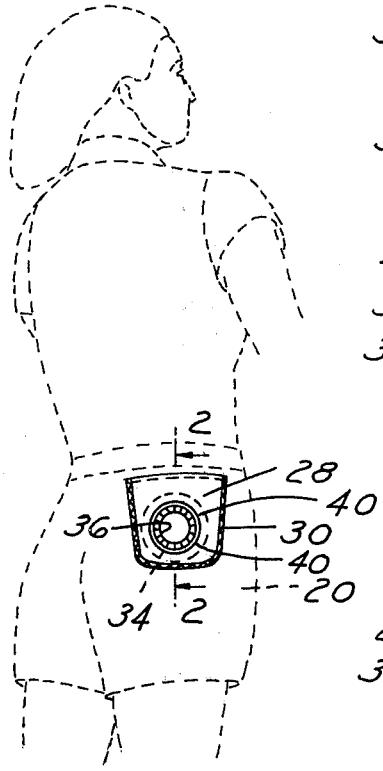
FIG. 1, a view of the ball retaining pocket on a garment.
Figure 2:
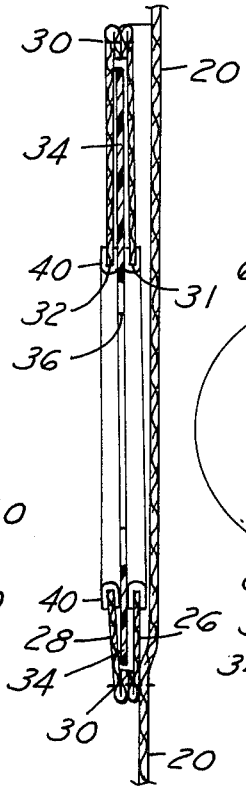
FIG. 2, a section on line 2—2 of FIG. 1.

With reference to the drawings, a tennis player is shown in FIG. 1 wearing shorts on which a pocket is sewn. As illustrated in FIG. 2, the garment cloth 20 carries a pocket stitched thereto.

The front of the pocket, in the embodiment shown, is composed of a double panel, namely, an inner panel 26 and an outer panel 28 which are each turned in at the edges and stitched together at 30 around the bottom and sides to each other and to the base fabric of the garment 20. At the top of the pocket, panels 26 and 28 are stitched together in a closed seam but not to the base fabric so the pocket is open at the top. Each panel 26 and 28 has a hole 31 and 32 which is of a size to permit a tennis ball to pass through.

Figure 3:
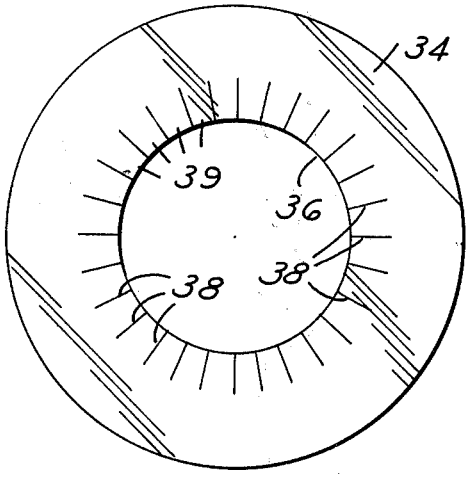
FIG. 3, a view of an insert for the outer wall of the pocket.
Figure 3A:
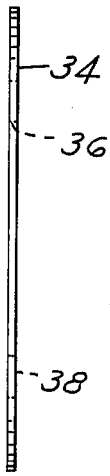
FIG. 3A, a side view of the insert illustrated in FIG. 3.
Figure 4:
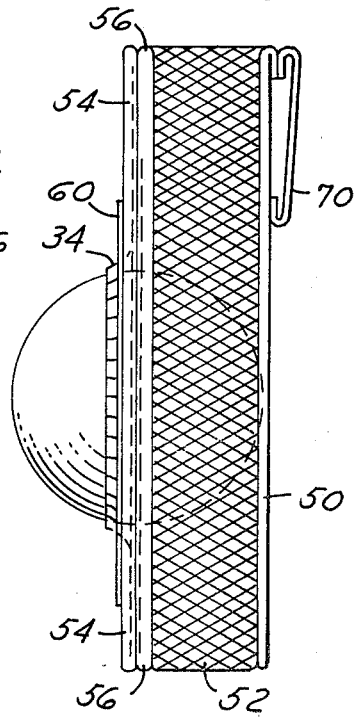

Entrapped between the panels 26 and 28 is a sheet 34 of material flexible in nature and preferably water impervious having a hole 36 which is provided with radial slits 38 around the periphery of the hole as shown in FIG. 3.

The basic diameter of hole 36 is less than that of a tennis ball but the flexible fingers or tabs 39 formed by the slits 38 will permit a ball to be removed through the hole with a little pressure on the outside of the pocket against the body, which causes the ball to snap into the palm and fingers of the player's hand and be ready for use on a serve. The plastic can be about a millimeter in thickness and formed of a flexible tough plastic material. The holes in the pocket panels can be about 3" in diameter and encircled with a binding 40 stitched around the periphery. The basic hole 36 in the plastic sheet 34 can be $2\frac{1}{2}$" and the slits cut to a 3" diameter. This will retain the tennis ball against accidental dislodgement from the pocket but will permit easy removal. A thinner plastic could be used depending on the inherent resilience to provide proper retention and ease of removal.

Figure 4:
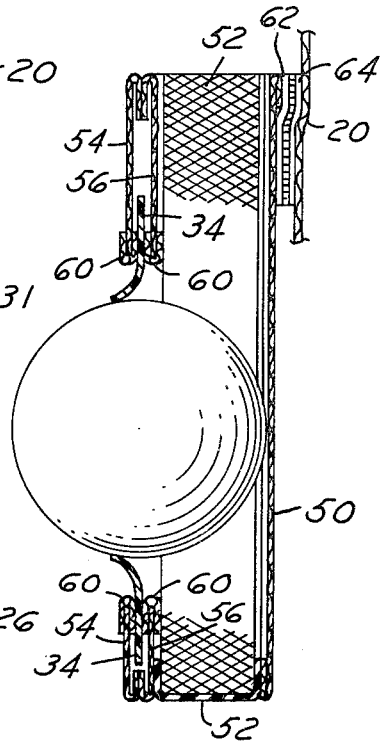
FIG. 4, a view of a modification in which Velcro strips are used to retain the pocket.

In FIGS. 4 and 5, modifications of the concept are illustrated. In FIG. 4, a pocket has a back panel 50 and a side and bottom strip 52 preferably made of an elastic ribbed material which stretches easily. A turned-in edge of the strip 52 is stitched to the back panel 50. As in FIGS. 1 and 2, double front panels 54, 56 are stitched together and to the side strip 52 at the sides and bottom and only to each other at the top. This is shown at the bottom of the sectional view of FIG. 4 where it will be seen that a turned-in edge of the strip insert 52 is stitched to turned-in facing edges of front panels 54 and 56, the holes in these panels being provided with a binding 60 stitched around the periphery of the holes.

A plastic insert sheet 34 is inserted between the panels 54 and 56 in the same manner as provided in FIGS. 1 and 2 and as illustrated in FIG. 3. The elastic strip 52, together with the flexing of the inner periphery of hole 56, will readily accommodate a tennis ball which can be retained until pressure is applied with fingers inwardly and around the protruding ball against the body of the player, which in effect causes the ball to snap out of the hole into the palm of the hand and fingers. This eliminates the need of going directly into the pocket itself to retrieve the ball. As an alternative, the ball may also be pushed out with the thumb into the palm and fingers of the player.

At the top of the pocket shown in FIG. 4 is a strip 62 of Velcro (Trademark) which cooperates with a similar strip 64 on a garment fabric 20. This retains the pocket on the clothing of the player.

In FIG. 5, a similar pocket is shown provided with belt loops 70 which will serve to secure the pocket to the clothing of a player.

What I claim is:

1. A retention pocket for tennis balls to be associated with the garment of a tennis player which comprises:

(a) a back panel, (b) a front panel overlying said back panel having a hole within the margins thereof to allow a tennis ball to pass, and (c) means at the perimeter of the hole in said front panel to resiliently retain a tennis ball in said pocket and to permit removal of said ball through said hole when inward pressure is applied around the ball against the body of the player to cause the ball to snap out of the pocket into the hand of the player.

2. A retention pocket as defined in claim 1 in which said front panel is composed of two sheets of material secured at the margins thereof and said means is retained between said sheets.

3. A retention pocket as defined in claim 1 in which said means comprises a sheet of flexible material having an aperture with resilient fingers at the periphery thereof.

4. A retention pocket as defined in claim 1 in which a resilient strip of material is interposed at the sides and bottom of the periphery of said pocket between the front and back panels.

5. A retention pocket as defined in claim 1 in which the back panel has loops thereon to receive the belt of a wearer.

6. A retention pocket as defined in claim 1 in which the back panel has a strip of Velcro to cooperate with a similar strip on the garment of a wearer.

* * * * *